US008436881B2

(12) United States Patent
Tamura

(10) Patent No.: US 8,436,881 B2
(45) Date of Patent: May 7, 2013

(54) IMAGE RECORDING MEDIUM TRANSFER APPARATUS AND IMAGE FORMATION APPARATUS

(75) Inventor: Kiyoshi Tamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 433 days.

(21) Appl. No.: 12/754,925

(22) Filed: Apr. 6, 2010

(65) Prior Publication Data

US 2010/0259591 A1 Oct. 14, 2010

(30) Foreign Application Priority Data

Apr. 13, 2009 (JP) ..... 2009-096660

(51) Int. Cl.
*B41J 2/325* (2006.01)

(52) U.S. Cl.
USPC ..... 347/215; 347/216; 347/217; 347/218; 347/219

(58) Field of Classification Search ..... 347/215–217; 437/215–219
See application file for complete search history.

(56) References Cited

U.S. PATENT DOCUMENTS 5,278,677 A * 1/1994 Lee et al. ..... 358/498
6,287,033 B1 * 9/2001 Hatakeyama et al. ..... 400/636

FOREIGN PATENT DOCUMENTS

JP 04041263 A * 2/1992
JP 07-223343 8/1995

* cited by examiner

*Primary Examiner* — Stephen Meier
*Assistant Examiner* — Sarah Al Hashimi
(74) *Attorney, Agent, or Firm* — Dentons US LLP

(57) ABSTRACT

An image recording medium transfer apparatus includes: a capstan that transfers a recording medium for an image; a pinch roller provided opposite the capstan to pass the recording medium between the pinch roller and the capstan; and a pressing force application unit configured to exert a pressing force to press the capstan and the pinch roller against each other via the recording medium. The capstan includes a plurality of projections on a pressing surface of the capstan that presses the recording medium. When a height of each of the projections from the pressing surface is defined as H, the height H is in a range of 20 mm<H≦40 mm.

9 Claims, 12 Drawing Sheets

IMAGE RECORDING MEDIUM TRANSFER APPARATUS AND IMAGE FORMATION APPARATUS

BACKGROUND OF THE INVENTION

1. Field of the Invention

The present invention relates to an image recording medium transfer apparatus and an image formation apparatus that include a capstan that transfers a recording medium for an image and a pinch roller provided opposite the capstan.

2. Description of the Related Art

In the related art, a thermal printer that forms an image on printing paper (a recording medium) with a thermal head on which a plurality of heat resistors (heat elements) are arranged is used as an image formation apparatus. In order to form an image with the thermal printer, first, printing paper is fed onto a platen. Next, the thermal head, which has been ascended away from the platen, is descended into pressure contact with the platen via an ink ribbon and the printing paper. Then, in this state, the heat resistors are caused to produce heat while transferring the printing paper in the printing direction (forward direction). This allows ink applied to the ink ribbon to be transcribed onto the printing paper to form an image.

In the case where a color image is to be formed, after an image is printed in a first color, the thermal head is ascended to release the pressure contact force which has been applied against the platen. Then, the printing paper is transferred in an opposite direction (reverse direction) to the printing direction back to a printing start position. After that, an image is printed in a second color over the image in the first color in the same manner as the image in the first color.

Accordingly, it is necessary to transfer the printing paper in both the forward and reverse directions for color printing. The printing paper is transferred by rotationally driving a capstan. Specifically, the printing paper is passed between the capstan which is to be rotationally driven and a pinch roller which is to follow the rotation of the capstan, and a pressing force is exerted to press the capstan and the pinch roller against each other via the printing paper. After that, the capstan is rotated in the forward or reverse direction to transfer the printing paper in the forward or reverse direction.

Thus, it is desired that the capstan should transfer the printing paper at a constant speed without positional displacement. Especially for color printing, in particular, a high transfer accuracy is necessary to prevent deviation between colors.

In view of the above, a plurality of pairs of capstans and pinch rollers may be provided and arranged in a plurality of rows to enhance the transfer accuracy. Specifically, a thermal printer in which printing paper is passed between a plurality of capstans and a plurality of pinch rollers and in which the capstans are rotated to transfer the printing paper in order to enable printing without color deviation is proposed (see Japanese Unexamined Patent Application Publication No. Hei 7-223343, for example).

SUMMARY OF THE INVENTION

By simply providing a plurality of rows of capstans and pinch rollers as disclosed in Japanese Unexamined Patent Application Publication No. Hei 7-223343, however, it may be difficult to maintain the enhanced transfer accuracy over a long period. For example, in the case where cylindrical capstans with a flat surface are used, the power for transferring the printing paper depends on the frictional force between the capstans and the printing paper. When paper powder or the like sticks to the capstans through use, the frictional force is lowered. This may prevent obtaining sufficient transfer power even with the plurality of capstans, and the printing paper may be displaced in position to cause color deviation.

In view of the above, a plurality of projections may be formed on a surface of a capstan that presses printing paper to obtain sufficient transfer power at all times. Specifically, a capstan on which projections are formed is pressed against printing paper, and the printing paper is transferred with the projections engaged in the back surface (an opposite surface to the printing surface) of the printing paper to ensure sufficient transfer power while preventing color deviation.

When the projections of the capstan are engaged in the printing paper, however, the engaged projections leave traces of the capstan on the front surface of the printing paper on which printing has been performed. The capstan traces are formed as bumps on the front surface of the printing paper, on the other side of which dents are formed by the projections of the capstan which are engaged in the back surface of the printing paper. The capstan traces make no contribution to the image quality, and rather degrade the appearance.

In view of the foregoing, it is desirable to ensure transfer power with projections of a capstan without leaving traces of the capstan.

The present invention addresses the foregoing issue through embodiments described below.

According to an embodiment of the present invention, there is provided an image recording medium transfer apparatus including: a capstan that transfers a recording medium for an image; a pinch roller provided opposite the capstan to pass the recording medium between the pinch roller and the capstan; and pressing force application means for exerting a pressing force to press the capstan and the pinch roller against each other via the recording medium, in which the capstan includes a plurality of projections on a pressing surface of the capstan that presses the recording medium, and when a height of each of the projections from the pressing surface is defined as H, the height H is in a range of $20\ \mu m < H \leqq 40\ \mu m$.

According to an embodiment of the present invention, there is provided an image formation apparatus including: a thermal head on which a plurality of heat elements are arranged to form an image on a recording medium; a platen provided opposite the thermal head to pass the recording medium between the platen and the thermal head; contact/separation means for contacting/separating the thermal head and the platen with/from each other via the recording medium; a capstan that transfers the recording medium; a pinch roller provided opposite the capstan to pass the recording medium between the pinch roller and the capstan; and pressing force application means for exerting a pressing force to press the capstan and the pinch roller against each other via the recording medium, in which the capstan includes a plurality of projections on a pressing surface of the capstan that presses the recording medium, and when a height of each of the projections from the pressing surface is defined as H, the height H is in a range of $20\ \mu m < H \leqq 40\ \mu m$.

According to the above embodiments of the present invention, a plurality of projections are provided on the pressing surface of the capstan. When the height of each of the projections from the pressing surface is defined as H, the height H is in the range of $20\ \mu m < H \leqq 40\ \mu m$. Therefore, when the pressing force application means presses the capstan against the recording medium, each of the projections with a height of 20 μm or more is engaged in the recording medium, and it is thus possible to transfer the recording medium without positional displacement.

Meanwhile, the projections engaged in the recording medium form dents in the back surface of the recording medium. However, each of the projections has a height of 40 μm or less, and it is thus possible to prevent the dents in the back surface from appearing as bumps on the front surface to form capstan traces.

DESCRIPTION OF THE PREFERRED EMBODIMENTS

Figure 1:
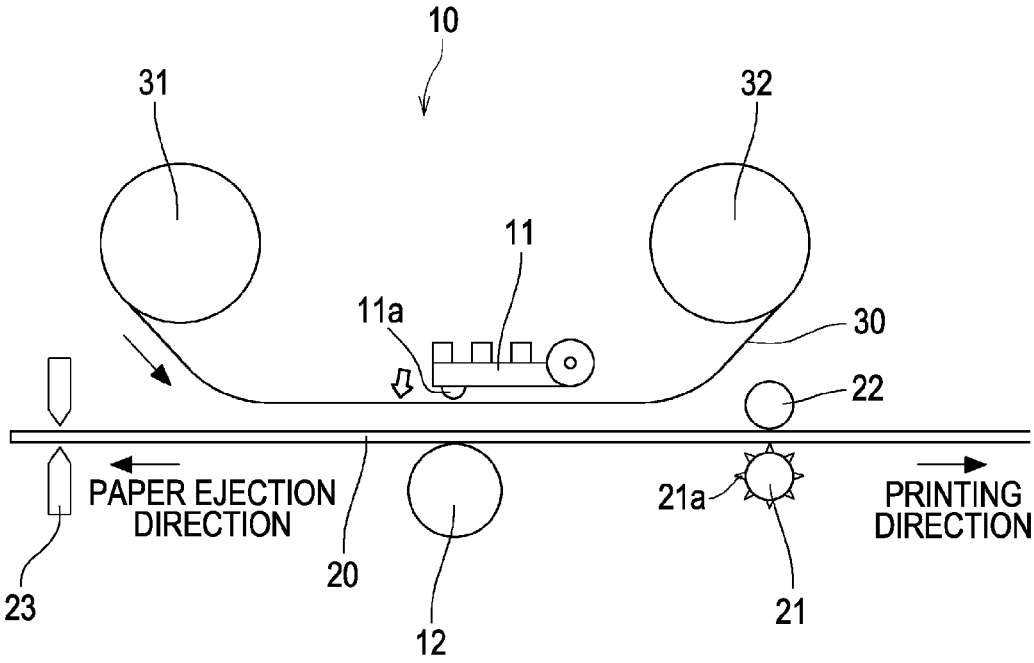
FIG. 1 is a side view showing the outline of a thermal printer serving as an image formation apparatus according to an embodiment of the present invention.

Embodiments of the present invention will be described below with reference to the drawings.

An image formation apparatus according to the embodiments of the present invention described below is a thermal printer 10 that performs color printing on printing paper 20 (a recording medium according to the present invention) with a dye-sublimation thermal head 11. An image recording medium transfer apparatus according to the embodiments of the present invention described below is incorporated in the thermal printer 10, and holds the printing paper 20 between a capstan 21 and a pinch roller 22 to transfer the printing paper 20 by rotationally driving the capstan 21.

The description will be made in the following order.

1. First Embodiment (example in which projections of capstan have triangular cross section)
2. Second Embodiment (example in which projections of capstan have trapezoidal cross section)
3. Third Embodiment (example in which fixation springs and adjustment springs are used as pressing force application unit)
4. Fourth Embodiment (example in which eccentric cam and coil spring are used as pressing force application unit)

<1. First Embodiment>

[Exemplary Configuration of Image Formation Apparatus]

FIG. 1 is a side view showing the outline of a thermal printer 10 serving as an image formation apparatus according to an embodiment of the present invention.

As shown in FIG. 1, the thermal printer 10 according to the embodiment includes a thermal head 11 on which a plurality of heat resistors 11*a* (heat elements according to the present invention) are arranged to form an image on printing paper 20. A platen 12 is provided opposite the thermal head 11 to pass the printing paper 20 between the platen 12 and the thermal head 11. The thermal head 11 and the platen 12 are contacted with and separated from each other via the printing paper 20 by a contact/separation unit (not shown).

The thermal printer 10 according to the embodiment further includes a capstan 21 that transfers the printing paper 21, and a pinch roller 22 provided opposite the capstan 21 to pass the printing paper 20 between the capstan 21 and the pinch roller 22. A pressing force is exerted by a pressing force application unit (not shown) to press the capstan 21 and the pinch roller 22 against each other via the printing paper 20. A plurality of projections 21*a* are provided on a surface of the capstan 21 that presses the printing paper 20.

Furthermore, the thermal printer 10 according to the embodiment is configured to transcribe ink of an ink ribbon 30 in order to form an image on an ink receiving layer of the printing paper 20, which also includes a base material portion in addition to the ink receiving layer. The printing paper 20 may be a paper medium that uses paper as the base material portion or a plastic medium that uses plastic as the base material portion. Both types of media may be used on the thermal printer 10 according to the embodiment.

The printing paper 20 is set in advance in a predetermined location inside the thermal printer 10. The printing paper 20 is fed onto the platen 12 by rotationally driving the capstan 21. Specifically, the printing paper 20 is first pulled out of a paper feed tray (not shown), then held between the projections 21*a* of the capstan 21 and the pinch roller 22, and transferred in a paper ejection direction (in the left direction of FIG. 1) by rotating the capstan 21 counterclockwise. The printing paper 20 is pulled out such that its base material portion faces the projections 21*a* of the capstan 21 and its receiving layer faces the pinch roller 22.

The printing paper 20 is fed such that its base material portion faces the platen 12 and its receiving layer faces the thermal head 11 and the ink ribbon 30. When printing is to be started, the printing paper 20 is transferred in the paper ejection direction (in the left direction of FIG. 1) with the leading end of the printing paper 20 passed between the thermal head 11 and the platen 12 and until the printing start position on the printing paper 20 reaches a position opposite the heat resistors 11*a* of the thermal head 11.

Meanwhile, the ink ribbon 30 is housed in a ribbon cassette (not shown), and pulled out of a supply reel 31 as indicated by an arrow shown in FIG. 1. After being pulled out, the ink ribbon 30 is passed between the thermal head 11 and the platen 12 while being guided by a guide roller (not shown) to be transferred in the right direction of FIG. 1 toward a take-up reel 32. The ink ribbon 30 is applied with color inks in three colors, namely yellow (Y), magenta (M), and cyan (C), and a transparent lamination ink (L) to allow color printing on the printing paper 20.

When a print command is input to the thermal printer 10, the thermal head 11 which has been ascended (in the state shown in FIG. 1) is descended by the contact/separation unit (not shown) as indicated by an arrow. Then, the heat resistors 11*a* are brought into pressure contact with the platen 12. Specifically, when the thermal head 11 is displaced toward the platen 12 as indicated by the arrow, a pressure contact force is exerted to bring the heat resistors 11*a* and the platen 12 into pressure contact with each other via the ink ribbon 30 and the printing paper 20. As a result, the ink ribbon 30 and the receiving layer of the printing paper 20 are brought into pressure contact with each other. The ink ribbon 30 and the printing paper 20 are held between the heat resistors 11*a* and the platen 12.

When the capstan 21 is rotated clockwise in this state, the printing paper 20 held between the capstan 21 and the pinch roller 22 which follows the rotation of the capstan 21 is transferred in a printing direction (in the right direction of FIG. 1). The ink ribbon 30 is pulled out of the supply reel 31 as indicated by the arrow, and transferred toward the take-up reel 32. Then, each of the heat resistors 11*a* of the thermal head 11 is selectively energized so that heat produced from the heat resistors 11*a* is transmitted to the ink ribbon 30. Accordingly, the yellow (Y) color ink on the ink ribbon 30 is sublimated and transcribed onto the receiving layer of the printing paper 20 to perform printing.

Such printing is executed for each of the yellow (Y), magenta (M), and cyan (C) colors. Therefore, the thermal head 11 is ascended for each transfer of the ink ribbon 30 for a change in color for transcription. When the capstan 21 is rotated in reverse (rotated counterclockwise), the printing paper 20 is transferred in the paper ejection direction (in the left direction of FIG. 1) to be returned to the printing start position. Then, each of the magenta (M) and cyan (C) color inks is transcribed in an overlapping manner in the same manner as the yellow (Y) color ink to form a color image.

Furthermore, the transparent lamination ink (L) is transcribed over the entire printed area (the color image) of the printing paper 20 to terminate the printing. After an image is formed on the printing paper 20, the thermal head 11 is ascended and the capstan 21 is rotated in reverse (rotated counterclockwise) to transfer the printing paper 20 in the paper ejection direction (in the left direction of FIG. 1) such that the trailing end of the image formation area of the printing paper 20 reaches a position opposite a cutter 23. After being cut at a predetermined length by the cutter 23, the printing paper 20 is ejected from a paper ejection port (not shown).

Accordingly, in the thermal printer 10 according to the embodiment, the capstan 21 is rotated in the forward and reverse directions to transfer the printing paper 20 in the printing direction and the paper ejection direction in order to form a color image. Therefore, it is necessary that the capstan 21 should have a high transfer accuracy to prevent deviation between colors. In the thermal printer 10 according to the embodiment, a plurality of projections 21*a* are formed on a surface of the capstan 21 that presses the printing paper 20.

A detailed description is made regarding this respect. A main cause of color deviation is that the transfer load due to the pressure contact force applied to the thermal head 11 and the platen 12 excels the transfer power produced by the capstan 21 and the pinch roller 22 to cause slipping of the printing paper 20. Therefore, in the thermal printer 10 according to the embodiment, the capstan 21 on which the projections 21*a* are formed is pressed against the printing paper 20 so that the projections 21*a* are engaged in the base material portion of the printing paper 20 by the pressing force of the capstan 21 during transfer. As a result, sufficient transfer power is secured to prevent the occurrence of color deviation.

When the printing paper 20 is transferred with the projections 21*a* of the capstan 21 engaged in the base material portion of the printing paper 20, however, bumps may be formed on the receiving layer side of the printing paper 20 on which printing has been performed to leave traces of the capstan, depending on how much the projections 21*a* are engaged. In particular, if the printing area is large, the thermal head 11 with a large width is used, and this increases the frictional force between the thermal head 11 and the printing paper 20, and hence increases the load of transferring the printing paper 20. Therefore, in order to ensure the transfer power, it is necessary to increase the amount of engagement of the projections 21*a* in the printing paper 20 by increasing the height of the projections 21*a*, which, however, tends to leave capstan traces.

Heat produced by the thermal head 11 during printing makes the printing paper 20 flexible, and hence increases the amount of engagement of the projections 21*a*. When the amount of deformation of the printing paper 20 due to the engagement of the projections 21*a* exceeds the elastic limit of the printing paper 20, capstan traces are left with the printing paper 20 kept deformed even after the projections 21*a* are disengaged.

Figure 2:
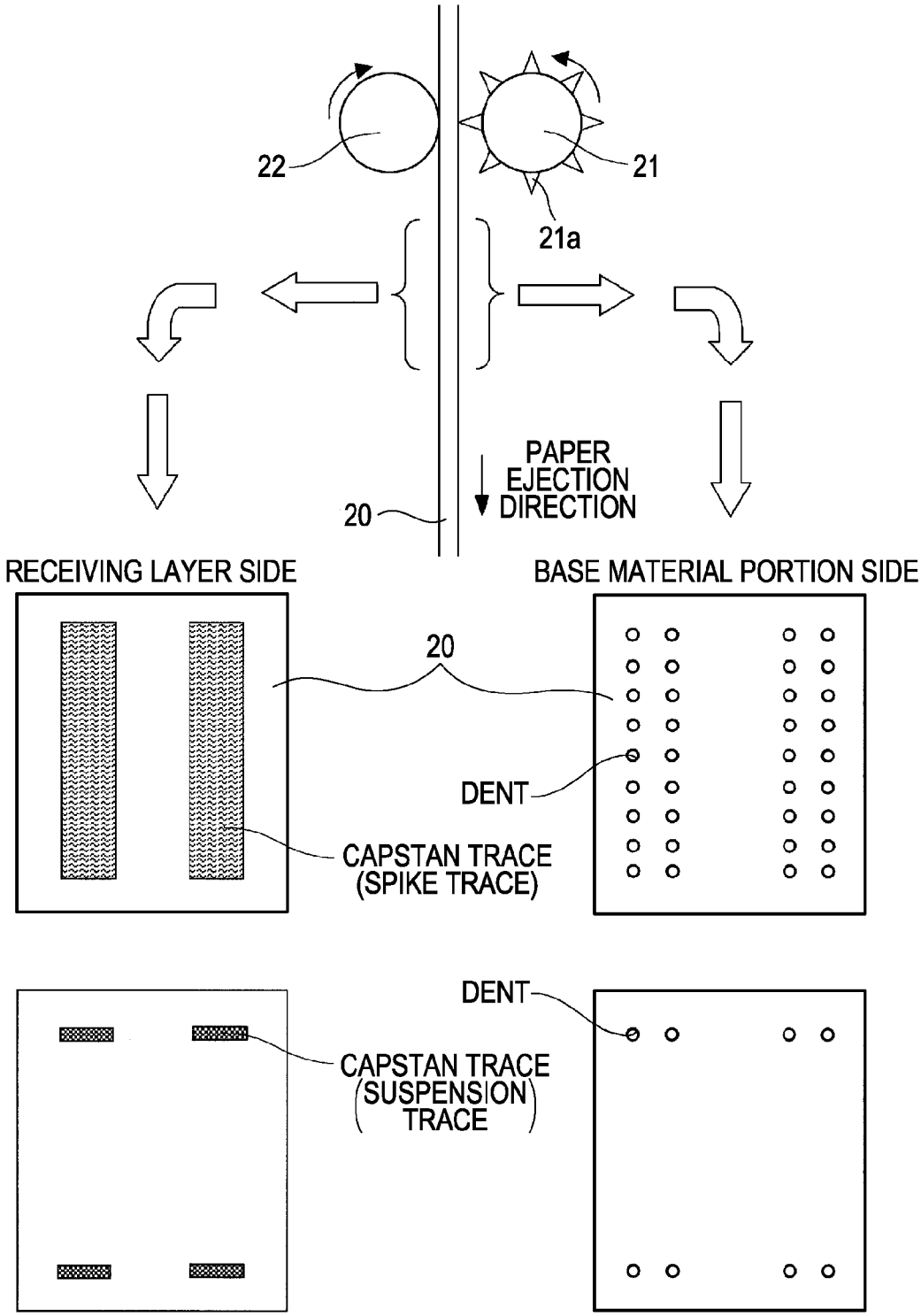
FIG. 2 illustrates traces of a capstan formed on printing paper by projections of the capstan.

FIG. 2 illustrates capstan traces formed on the printing paper 20 by the projections 21*a* of the capstan 21.

As shown in FIG. 2, the printing paper 20 is held between the capstan 21 and the pinch roller 22. The plurality of projections 21*a* are formed on the capstan 21 each at both ends of the capstan 21 in the width direction.

When the capstan 21 is rotationally driven, the projections 21*a* are engaged in the printing paper 20 since the capstan 21 is pressed against the printing paper 20. Consequently, two rows of dents corresponding to the projections 21*a* are continuously formed on the base material portion side of the printing paper 20. Therefore, two rows of capstan traces (the dents as seen from the receiving layer side) corresponding to the dents on the base material portion side of the printing paper 20 are continuously formed on the receiving layer side of the printing paper 20. Such capstan traces are formed by the projections 21*a* of the rotating capstan 21 continuously denting the printing paper 20 in the printing direction, and are called "spike traces".

Meanwhile, when the rotation of the capstan 21 is suspended, the printing paper 20 is held between the capstan 21 and the pinch roller 22 with the capstan 21 and the pinch roller 22 pressed against each other. Therefore, the projections 21*a* of the capstan 21 are engaged in the printing paper 20. The projections 21*a* are engaged deeper as the time of the suspension of the capstan 21 is longer. Thus, dents are formed on a portion of the printing paper 20 that is on the capstan 21 which has been stationary for a while to leave capstan traces. Such capstan traces are formed by the projections 21*a* of the stationary capstan 21 partially denting the printing paper 20, and are called "suspension traces".

As described above, the projections 21*a* of the capstan 21 in pressure contact with the printing paper 20 leave capstan traces (spike traces and suspension traces) on the printing paper 20. However, the projections 21*a* are necessary to ensure power for transferring the printing paper 20 and prevent color deviation. Therefore, there is a trade-off between the transfer power and the capstan traces. Specifically, increasing the transfer power to prevent color deviation results in remarkable capstan traces, while conversely reducing the pressing force to reduce the capstan traces results in low transfer power to cause color deviation. In the related art, prevention of color deviation has been given priority over reduction of the capstan traces, and the capstan traces on the printing paper 20 have been practically overlooked.

In view of the above, the thermal printer 10 according to the embodiment optimizes a height H of the projections 21*a* of the capstan 21 to prevent the appearance of capstan traces on the printing paper 20 while ensuring the power for transferring the printing paper 20.

[Exemplary Configuration of Capstan]

Figure 3A:
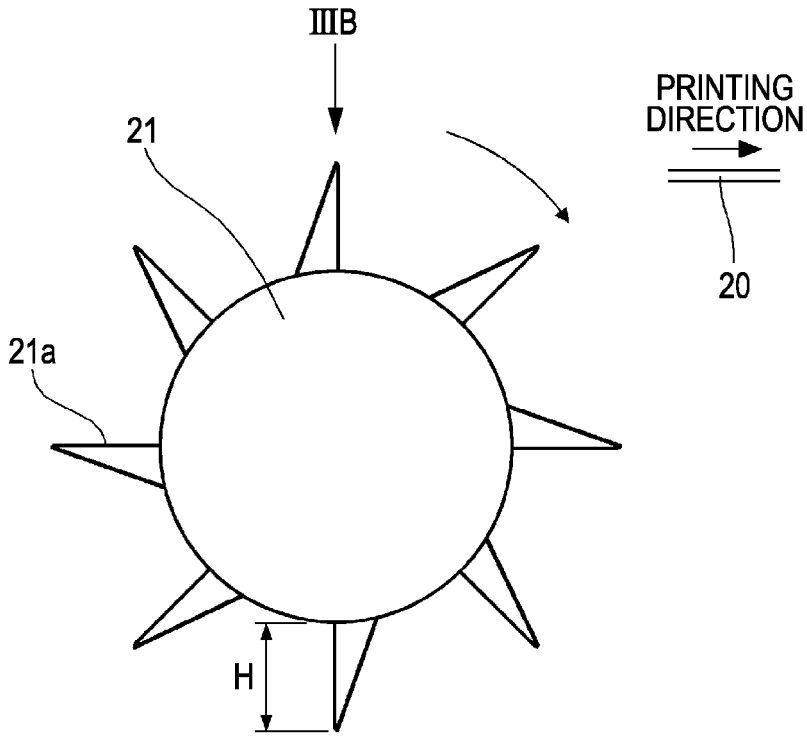
FIG. 3A is a side view of the projections of the capstan in the thermal printer serving as the image formation apparatus according to the embodiment of the present invention.
Figure 3B:
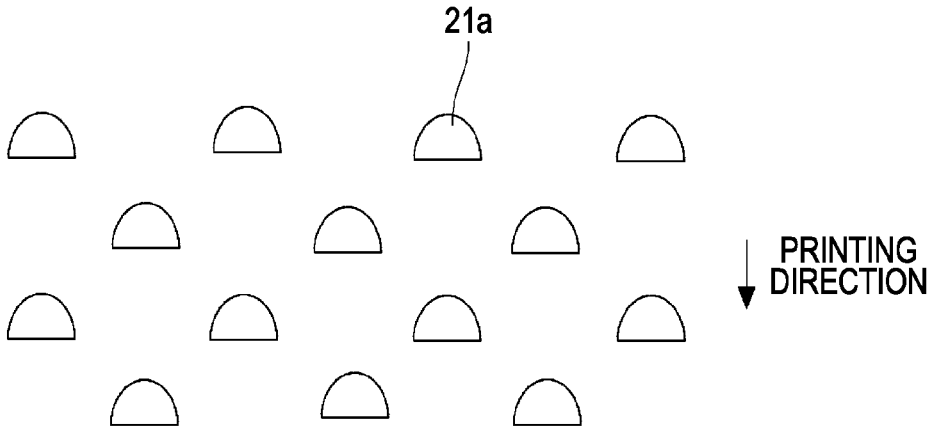
FIG. 3B is a plan view of the projections of the capstan in the thermal printer serving as the image formation apparatus according to the embodiment of the present invention.

FIGS. 3A and 3B are a side view and a plan view, respectively, of the projections 21*a* of the capstan 21 in the thermal printer 10 serving as the image formation apparatus according to the embodiment of the present invention.

As shown in FIGS. 3A and 3B, a plurality of projections 21*a* are provided on a surface of the capstan 21 that presses the printing paper 20. All the projections 21*a* are formed to be semicircular on the upstream side and be straight on the downstream side in the printing direction and arranged in the same orientation as each other so that the power for transferring the printing paper 20 in the printing direction (in an image formation direction) is higher than the power for transferring the printing paper 20 in the opposite direction.

Such projections 21*a* exhibit transfer power matching the transfer load, by producing low transfer power during reverse operation in which the printing paper 20 is returned and high transfer power during forward operation in which the printing paper is fed in the printing direction (in a direction with a high transfer load). It has been experimentally verified that the projections 21*a* formed to be arranged in the same orientation produce transfer power in the printing direction that is 20 to 30 percent higher compared to projections formed with their semicircular portions arranged in both orientations alternately to obtain the same transfer power in the printing direction and in the reverse direction.

The projections 21*a* have a triangular cross section in the height direction, with the tip angle of the triangle being 80 degrees. Increasing the tip angle improves the transfer power. It has been experimentally verified that the transfer power is higher when the tip angle is 60 degrees than when the tip angle is 40 degrees. It has further been experimentally confirmed that the transfer power with the tip angle being 80 degrees is higher than the transfer power with the tip angle being 60 degrees by about 10 percent. If the tip angle is so obtuse, however, the resistance to engagement in the printing paper 20 is increased, which reduces the amount of engagement in the printing paper 20 to lower the transfer power. Thus, the tip angle of the triangle is optimally 80 degrees as in the projections 21*a* according to the embodiment. In FIG. 3A, the projections 21*a* are illustrated in a different shape from their actual shape to emphasize the projections 21*a*.

Furthermore, when the height of each of the projections 21*a* from the pressing surface is defined as H, the height H is in the range of 20 μm<H≦40 μm. The height H of each of the projections 21*a* is in the above range to prevent the appearance of capstan traces while ensuring the transfer power. Specifically, when the height H of each of the projections 21*a* is more than 20 μm, sufficient power for transferring the printing paper 20 is ensured to prevent positional displacement. Meanwhile, when the height H of each of the projections 21*a* is 40 μm or less, no capstan traces are formed on the printing paper 20 to provide excellent printing quality.

Figure 4:
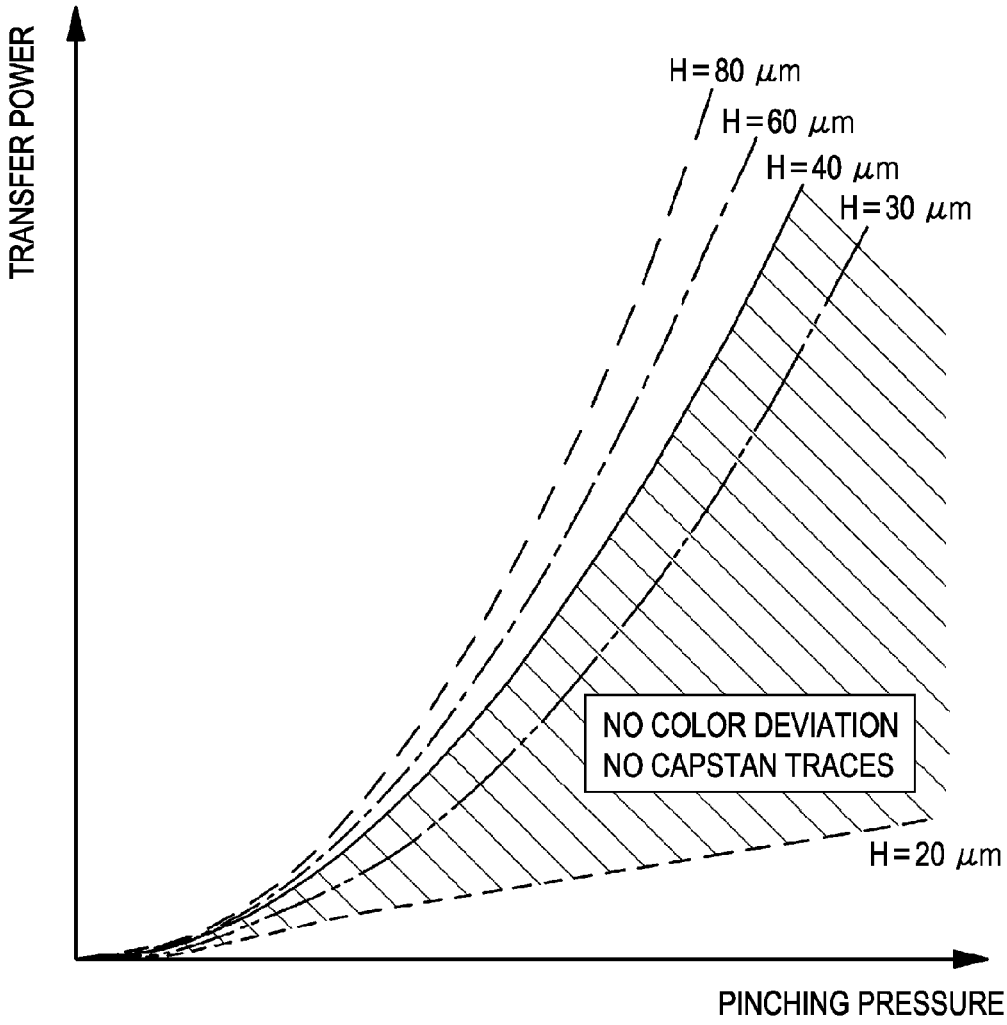
FIG. 4 is a graph showing the relationship between the height of the projections of the capstan and the power for transferring the printing paper.

FIG. 4 is a graph showing the relationship between the height H of the projections of the capstan 21 and the power for transferring the printing paper 20.

As shown in FIG. 4, the relationship between the pinching pressure (the pressing force of the pinch roller 22 shown in FIG. 2) and the transfer power was experimentally confirmed for five values of the projection height H, namely 20 μm, 30 μm, 40 μm, 60 μm, and 80 μm.

For any value of the projection height H, the transfer power is increased by increasing the pinching pressure. When the projection height H is 20 μm, however, increasing the pinching pressure does not significantly increase the transfer power. Therefore, necessary transfer power may not be ensured to cause color deviation. Thus, it is necessary that the projection height H should be more than 20 μm.

When the projection height H is more than 20 μm (equal to 30 μm, 40 μm, 60 μm, and 80 μm), the transfer power increases quadratically as the pinching pressure increases. Therefore, necessary transfer power may be ensured to prevent color deviation.

When the projection height H is 60 μm and 80 μm, however, capstan traces are formed. Meanwhile, when the projection height H is 40 μm or less, the capstan traces are suppressed to an invisible level.

The presence or absence of color deviation and the presence or absence of capstan traces were determined through visual observation performed by a plurality of persons. This is because the presence or absence of color deviation or capstan traces are in practice determined through visual observation. Such visual observation is considered to be more objective than determination performed by digitalizing the degree of color deviation and bumps and dents on the surface of the printing paper 20 (see FIG. 2). The capstan traces tended to be obscure in the case where the printing paper 20 was a plastic medium, while the capstan traces tended to be clear in the case where the printing paper 20 was a paper medium. Recently, an increasing amount of paper media, which are advantageous in terms of cost, has been used. Therefore, the presence or absence of color deviation and the presence or absence of capstan traces were determined using paper media.

As described above, the presence or absence of color deviation and the presence or absence of capstan traces were determined through visual observation using paper media on which capstan traces are easily formed for each projection height H. As a result, it was verified that no color deviation was caused and no capstan traces were formed when the projection height H was in the range of 20 μm<H≦40 μm. Thus, by using the projection height H in the range of 20 μm<H≦40 μm, it is possible to provide sufficient transfer power, prevent color deviation, and prevent the appearance of capstan traces, for either of plastic media and paper media, in order to improve the printing quality.

Figure 5:
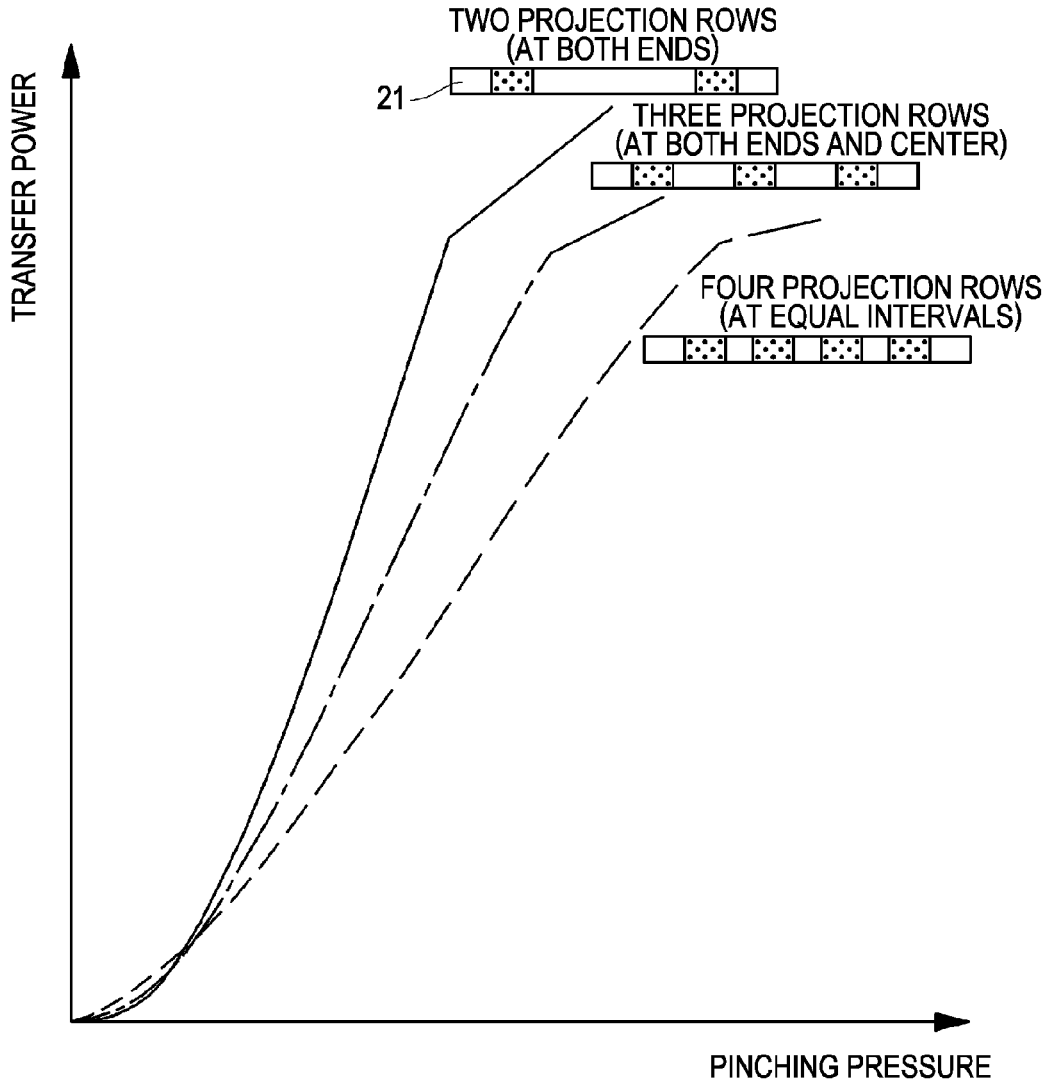
FIG. 5 is a graph showing the relationship between the number of rows of the projections of the capstan and the power for transferring the printing paper.

FIG. 5 is a graph showing the relationship between the number of rows of the projections of the capstan 21 and the power for transferring the printing paper 20.

As shown in FIG. 5, the relationship between the pinching pressure (the pressing force of the pinch roller 22 shown in FIG. 2) and the transfer power was experimentally confirmed for three cases, namely a case where two rows of the projections 21*a* (see FIGS. 3A and 3B) were formed at both ends of the capstan 21, a case where three rows of the projections 21*a* were formed at both ends and the center of the capstan 21, and a case where four rows of the projections 21*a* were formed at equal intervals on the capstan 21.

For any number of projection rows, the transfer power is increased quadratically by increasing the pinching pressure. When the pinching pressure reaches a certain level or higher, the projections 21*a* (see FIGS. 3A and 3B) are engaged in the printing paper 20 to their roots. Therefore, the transfer power thereafter increases gently linearly with a frictional force exerted at the roots of the projections 21*a*.

While the transfer power exhibits the same tendency for any number of projection rows as described above, the transfer power is highest in the case where two rows of the projections are provided at both ends of the capstan for the same pinching pressure. Thus, the projections are optimally provided in two rows at both ends of the capstan. While the projections 21*a* (see FIGS. 3A and 3B) may be increased in either of the thrust direction and the radial direction, increasing the projections 21*a* in the thrust direction affects the transfer power more than increasing the projections 21*a* in the radial direction. This is considered to be because increasing the number of projections in the radial direction does not accordingly increase the number of projections to be actually engaged in the printing paper 20 (especially, the amount of engagement of projections reduces toward both ends), since the number of projections to be engaged in the printing paper 20 (see FIG. 2) is limited due to the cylindrical shape of the pressing surface of the capstan 21. Thus, it is preferable to first increase the projections 21*a* in the thrust direction, and in the case where the transfer power is still insufficient, to increase the projections 21*a* in the radial direction.

In the case where two rows of the projections 21*a* (see FIGS. 3A and 3B) are formed at both ends of the capstan, the transfer power is high because the amount of engagement of the projections 21*a* is large. A large amount of engagement may cause the appearance of capstan traces.

Even if the projections 21*a* are engaged in the printing paper 20 (see FIG. 2) to form dents in the printing paper 20, however, the capstan traces disappear if such dents are recovered.

Figure 6:
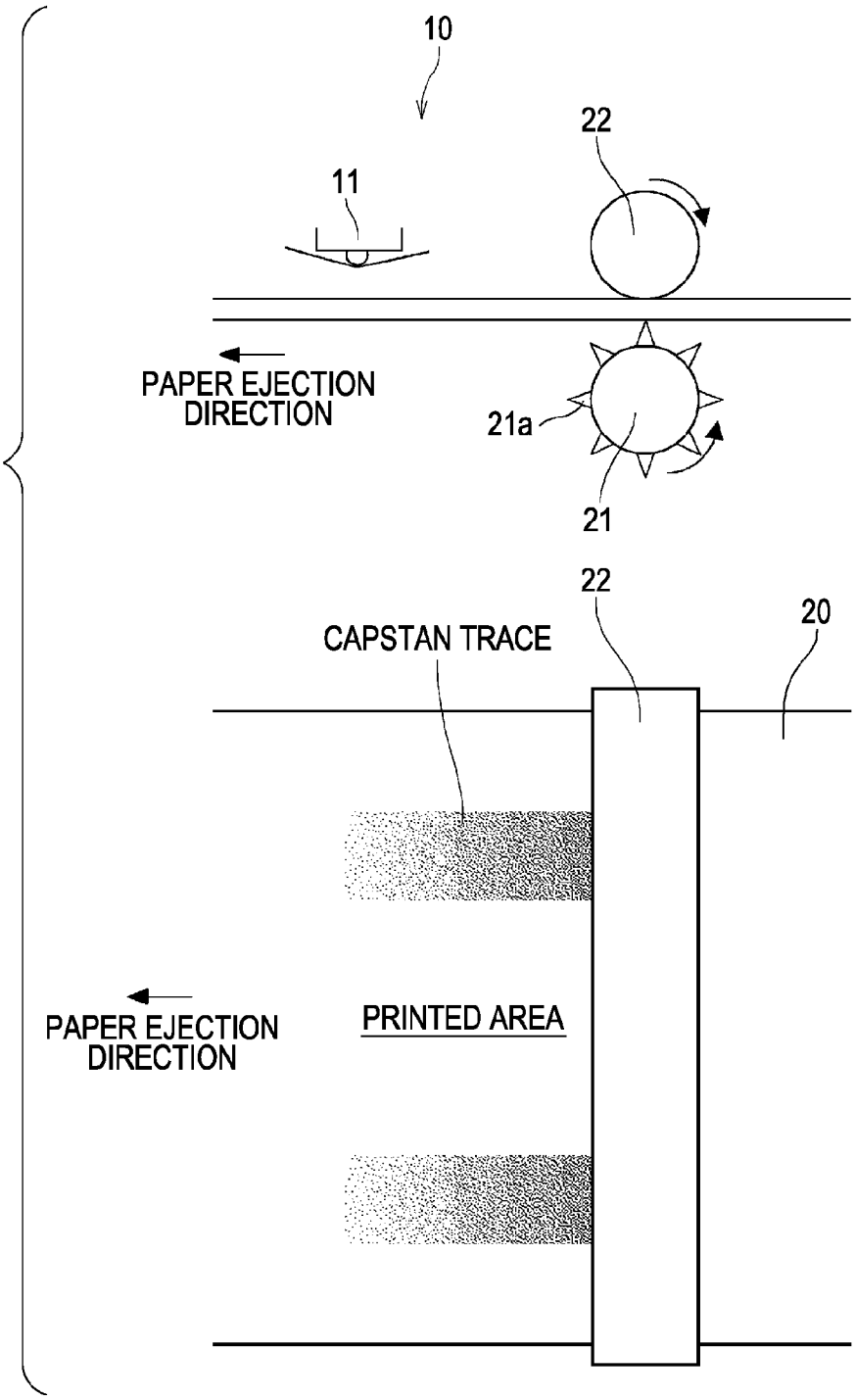
FIG. 6 illustrates how the capstan traces disappear in the thermal printer serving as the image formation apparatus according to the embodiment of the present invention.

FIG. 6 illustrates how the capstan traces disappear in the thermal printer 10 serving as the image formation apparatus according to the embodiment of the present invention.

As shown in FIG. 6, the capstan 21 in the thermal printer 10 according to the embodiment has two rows of projections 21*a* at both ends of a surface of the capstan 21 that presses the printing paper 20, each row of projections including a plurality of projections.

When the thermal head 11 is ascended and the printing paper 20 held between the capstan 21 and the pinch roller 22 is transferred in the paper ejection direction (in the left direction of FIG. 6) by rotating the capstan 21 counterclockwise, capstan traces are formed. Specifically, each of the projections 21*a* of the capstan 21 is engaged in the printing paper 20 during transfer of the printing paper 20. Therefore, capstan traces are formed in correspondence with the two rows of the projections 21*a* in the printed area of the printing paper 20.

However, the pinching pressure (a pressing force applied against the capstan 21) of the pinch roller 22 is suitably adjusted by the pressing force application unit (not shown). In other words, the pressing force application unit adjusts the pinching pressure such that dents formed in the printing paper 20 by the projections 21*a* of the capstan 21 are within the elastic limit of the printing paper 20. Therefore, although the projections 21*a* of the capstan 21 are engaged in the printing paper 20 within its elastic limit to form dents within the elastic limit of the printing paper 20, such dents do not enter the plastic range of the printing paper 20. Thus, the capstan traces that appear due to the dents in the printed area disappear naturally in the course of time. As a result, the printing paper 20 is ejected with no capstan traces.

As described above, the pinching pressure of the pinch roller 22 is adjusted by the pressing force application unit (not shown). Moreover, in the thermal printer 10 according to the embodiment, the projections 21*a* of the capstan 21 are optimized in shape and so forth (see FIGS. 4 and 5). Therefore, it is possible to suppress capstan traces with the capstan 21 alone. It is also possible to improve the printing quality at low cost, and to support printing paper with a large width.

<2. Second Embodiment>

[Exemplary Configuration of Capstan]

Figure 7:
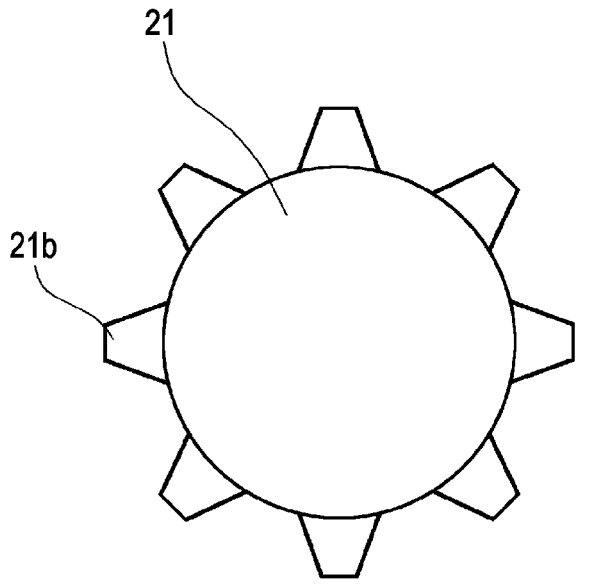
FIG. 7 is a side view of projections of a different type of a capstan in a thermal printer serving as an image formation apparatus according to an embodiment of the present invention.
Figure 7:
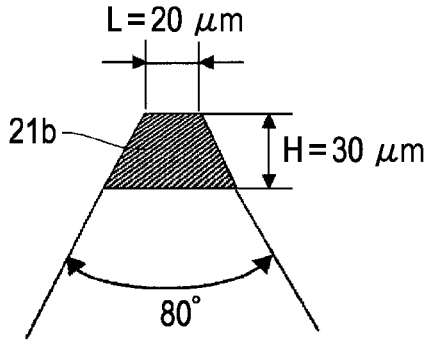

FIG. 7 is a side view of projections 21*b* of a different type of a capstan 21 in a thermal printer 10 serving as an image formation apparatus according to an embodiment of the present invention.

A plurality of projections 21*b* are formed on the pressing surface of the capstan 21 shown in FIG. 7. All the projections 21*b* have a trapezoidal cross section in the height direction.

Each of the projections 21*b* has a tip angle of 80 degrees, a height H of 30 μm, and an upper base whose length L is 20 μm. Such projections 21*b* with a large tip angle of 80 degrees and a height H of 30 μm ensure sufficient transfer power (see FIG. 4). The transfer power may further be increased by setting the length L of the upper base of the trapezoid to 20 μm.

Figure 8:
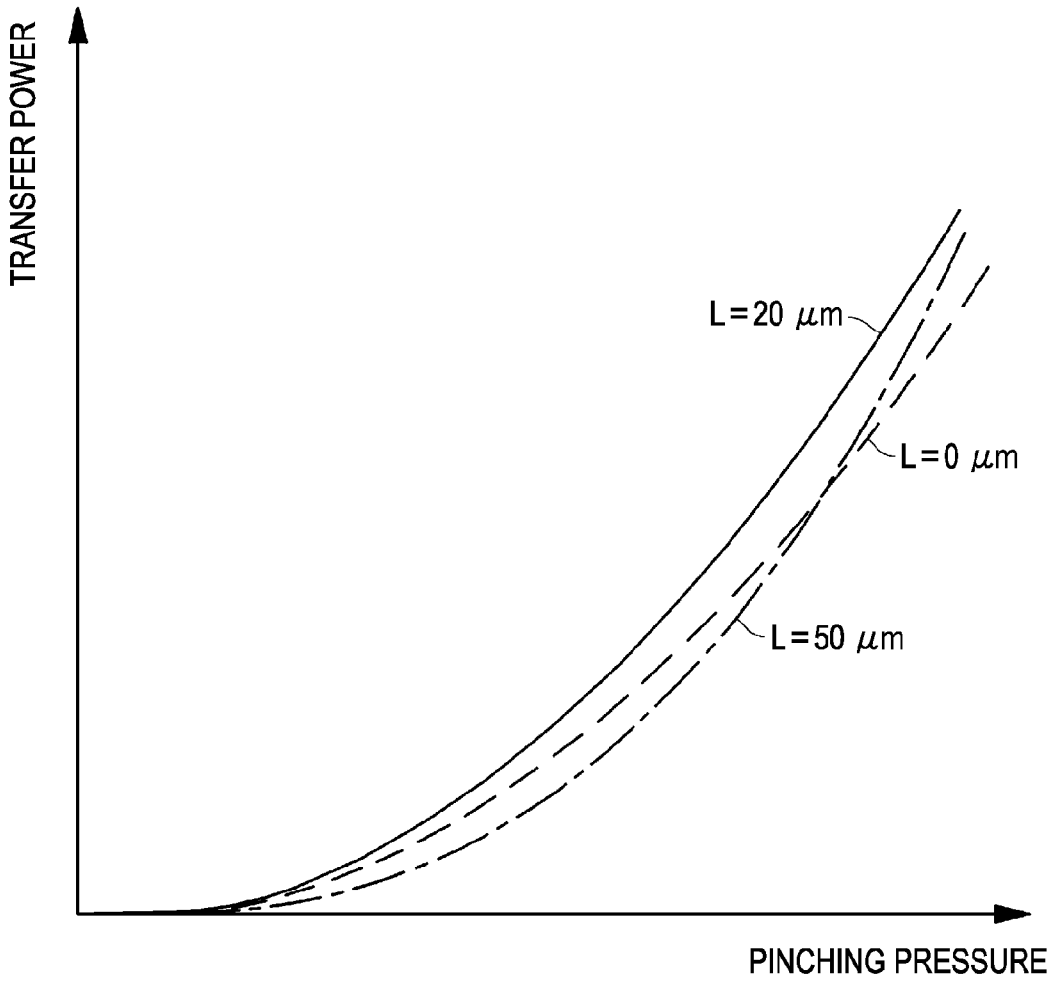
FIG. 8 is a graph showing the relationship between the shape of the projections of the capstan and the power for transferring the printing paper.

FIG. 8 is a graph showing the relationship between the shape of the projections of the capstan 21 and the power for transferring the printing paper 20.

In the case of projections with a trapezoidal cross section as with the projections 21*b* (see FIG. 7), the transfer power varies in accordance with the length L of the upper base of the trapezoid as shown in FIG. 8. Specifically, it has been experimentally confirmed that the transfer power in the case where the length L of the upper base is 20 μm is increased by about 20 percent compared to the case where the length L of the upper base is 0 μm. It has also been experimentally confirmed that the transfer power in the case where the length L of the upper base is 20 μm is increased compared to the case where the length L of the upper base is 50 μm, especially on condition that the pinching pressure is low.

Thus, it is preferable that the length L of the upper base of the projections 21*b* (see FIG. 7) with a trapezoidal cross section in the height direction is in the range of $0\ \mu m < L \leqq 50\ \mu m$. The length L of the upper base is larger than 0 μm because the projections 21*b* are triangular, rather than trapezoidal, if the length L of the upper base is 0 μm. In the case where the length L of the upper base is larger than 50 μm, in contrast, the resistance to engagement of the projections 21*b* in the printing paper 20 (see FIG. 2) is increased to lower the transfer power in a region where the pinching pressure is low as shown in FIG. 8.

<3. Third Embodiment>

[Exemplary Configuration of Image Formation Apparatus]

Figure 9:
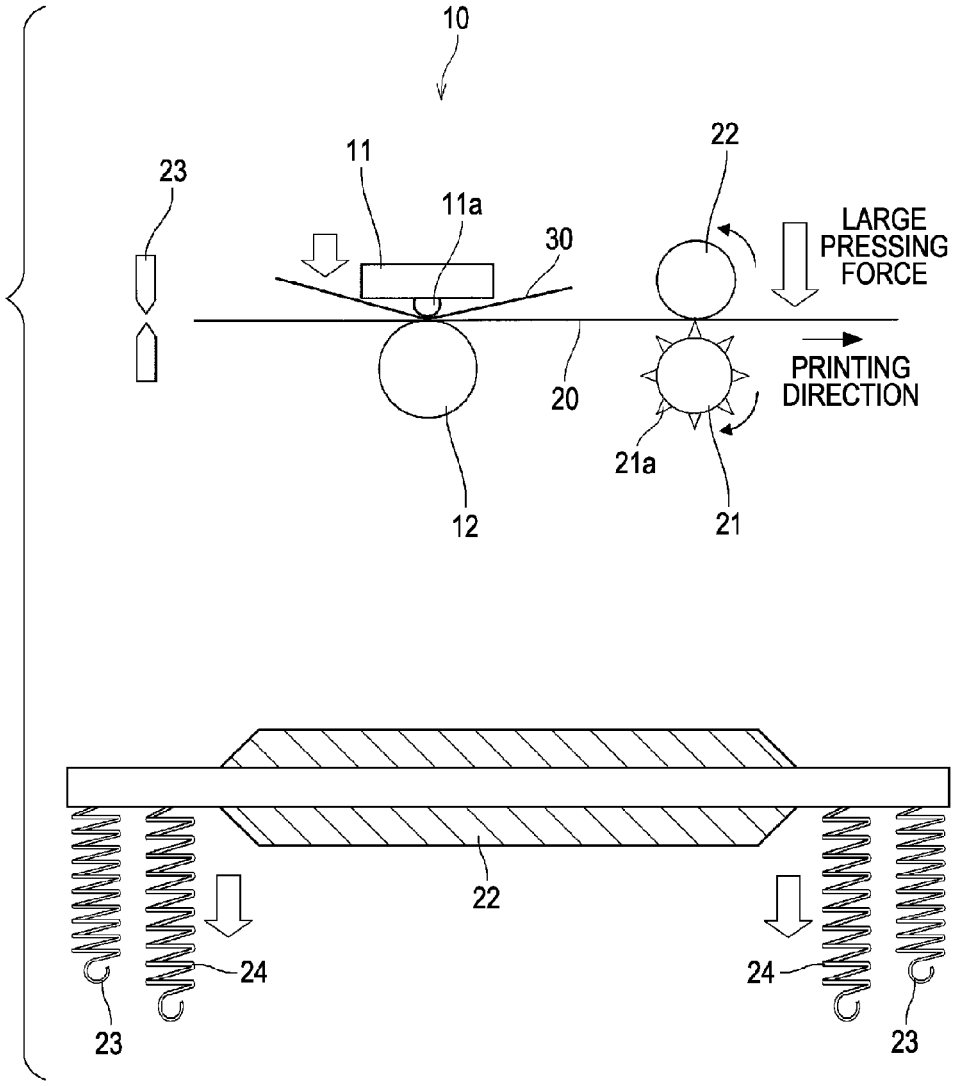
FIG. 9 is a front view of an exemplary pressing force application unit in a thermal printer serving as an image formation apparatus according to an embodiment of the present invention, showing a state in which a large pressing force is applied.

FIG. 9 is a front view of an exemplary pressing force application unit in a thermal printer 10 serving as an image formation apparatus according to an embodiment of the present invention, showing a state in which a large pressing force is applied.

Figure 10:
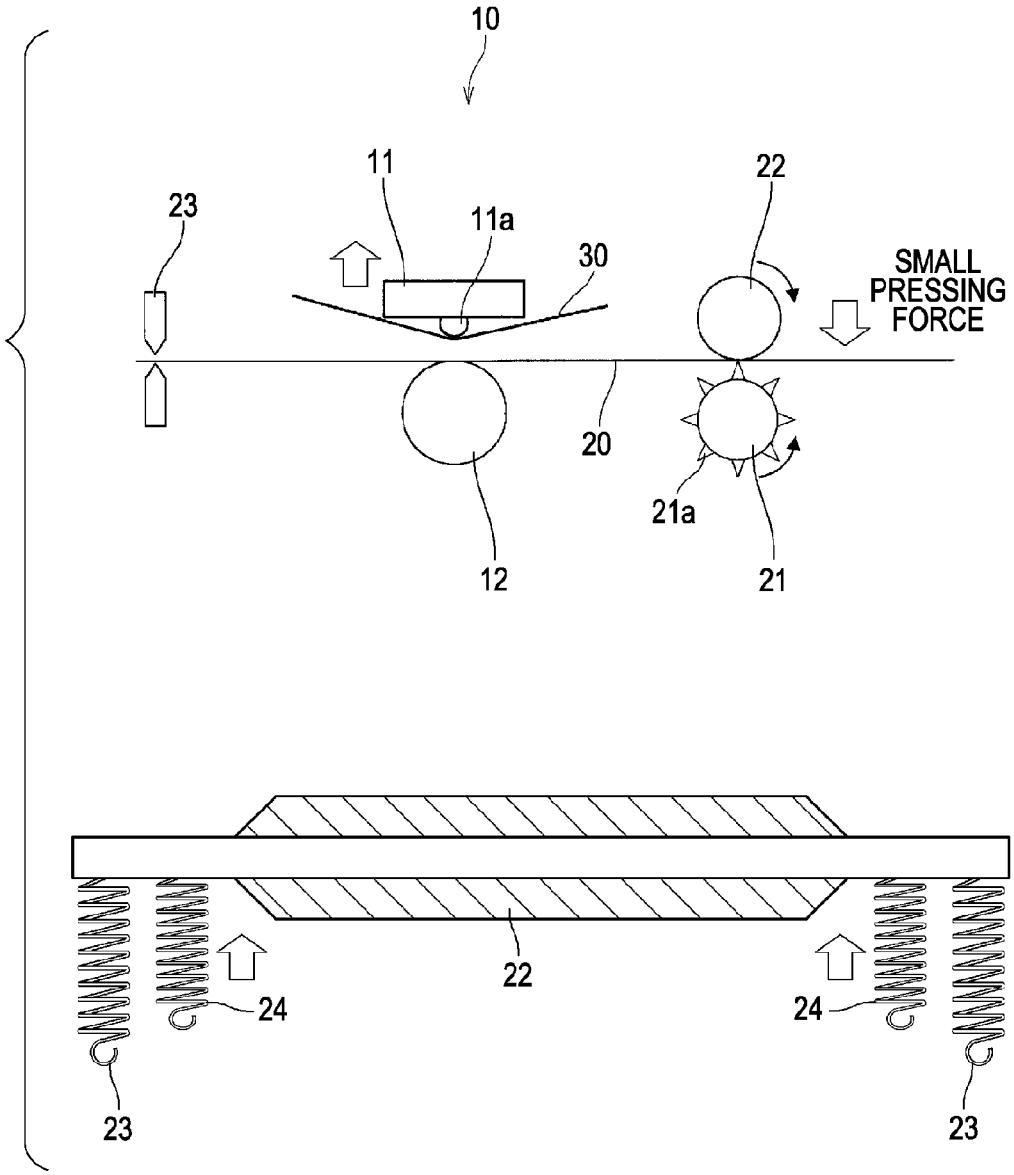
FIG. 10 is a front view of the exemplary pressing force application unit in the thermal printer serving as the image formation apparatus according to the embodiment of the present invention, showing a state in which a small pressing force is applied.

Meanwhile, FIG. 10 is a front view of the exemplary pressing force application unit in the thermal printer 10 serving as the image formation apparatus according to the embodiment of the present invention, showing a state in which a small pressing force is applied.

As shown in FIGS. 9 and 10, the thermal printer 10 according to the embodiment includes a pair of fixation springs 23 and a pair of adjustment springs 24 serving as a pressing force application unit configured to exert a pressing force to press the capstan 21 and the pinch roller 22 against each other via the printing paper 20.

The fixation springs 23 and the adjustment springs 24 are respectively provided at both ends of the pinch roller 22 to urge the pinch roller 22 toward the capstan 21. Each of the fixation springs 23 is coupled to a housing (not shown) of the thermal printer 10 to exert a constant spring force on the pinch roller 22 at all times.

Meanwhile, each of the adjustment springs 24 is coupled to the thermal head 11 such that the spring force produced when a contact/separation unit (not shown) establishes no contact between the thermal head 11 and the platen 12 is smaller than the spring force produced when the contact/separation unit establishes such contact.

In order to perform printing with the thermal printer 10 according to the embodiment, the thermal head 11 is descended by the contact/separation unit (not shown) configured to contact/separate the thermal head 11 and the platen 12 with/from each other as shown in FIG. 9. Then, the heat resistors 11*a* are brought into pressure contact with the platen 12 to hold the ink ribbon 30 and the printing paper 20 between the heat resistors 11*a* and the platen 12. After that, while the capstan 21 is rotated clockwise to transfer the printing paper 20 in the printing direction (in the right direction of FIG. 9), the heat resistors 11*a* are energized to transcribe each ink on the ink ribbon 30 onto the printing paper 20 in order to perform printing.

Meanwhile, when the printing paper 20 is to be transferred without being printed (when the printing paper 20 is to be returned to the printing start position or to be ejected), the thermal head 11 is ascended as shown in FIG. 10. Then, the capstan 21 is rotated counterclockwise to transfer the printing paper 20 in the paper ejection direction (in the left direction of FIG. 10). In the case where the printing paper 20 is to be ejected, the printing paper 20 is cut by the cutter 23 at a predetermined length.

If the printing paper 20 is transferred with a large pressing force when no printing is performed (such as during paper ejection) as when printing is performed (such as during transcription), however, the projections 21*a* of the capstan 21 leave capstan traces.

Thus, in the thermal printer 10 according to the embodiment, the pressing force of the pinch roller 22 is reduced when no printing is performed (such as during paper ejection). Specifically, the pair of adjustment springs 24 which form the pressing force application unit are coupled to the contact/separation unit (not shown). The pair of adjustment springs 24 are configured to apply a smaller pressing force of the pinch roller 22 when the thermal head 11 and the platen 12 are in no contact with each other (when no image is to be formed on the printing paper 20) than the pressing force applied when the thermal head 11 and the platen 12 are in contact with each other (when an image is to be formed on the printing paper 20).

Thus, when no printing is performed with the thermal head 11 ascended and the printing paper 20 not held between the thermal head 11 and the platen 12, the transfer load (the frictional force between the thermal head 11 and the printing paper 20 and so forth) is low, and the pressing force of the pinch roller 22 is accordingly reduced. As a result, it is possible to smoothly transfer the printing paper 20 while preventing the appearance of capstan traces.

The thermal printer 10 according to the embodiment changes the pressing force utilizing ascent and descent of the thermal head 11 as described above, with a focus placed on the difference in power for transferring the printing paper 20 necessary when printing is performed (when the thermal head 11 is descended) and when no printing is performed (when the thermal head 11 is ascended). Specifically, when printing is performed, high transfer power is necessary, and the adjustment springs 24 are pulled in conjunction with the descent of the thermal head 11 as shown in FIG. 9 in an attempt to increase the transfer power of the capstan 21. Therefore, the pressing force of the pinch roller 22 is increased, as a result of which the transfer power of the capstan 21 is increased.

Conversely, when no printing is performed, low transfer power is sufficient, and the adjustment springs 24 are contracted in conjunction with the ascent of the thermal head 11 as shown in FIG. 10 to reduce the pressing force of the pinch roller 22 (to 50 N or less, for example). As a result, the amount of engagement of the projections 21*a* of the capstan 21 in the printing paper 20 is reduced to further suppress capstan traces (especially, suspension traces formed when the cutter 23 cuts the printing paper 20). The fixation springs 23 ensure a minimum necessary pressing force of the pinch roller 22.

<4. Fourth Embodiment>

[Exemplary Configuration of Image Formation Apparatus]

Figure 11:
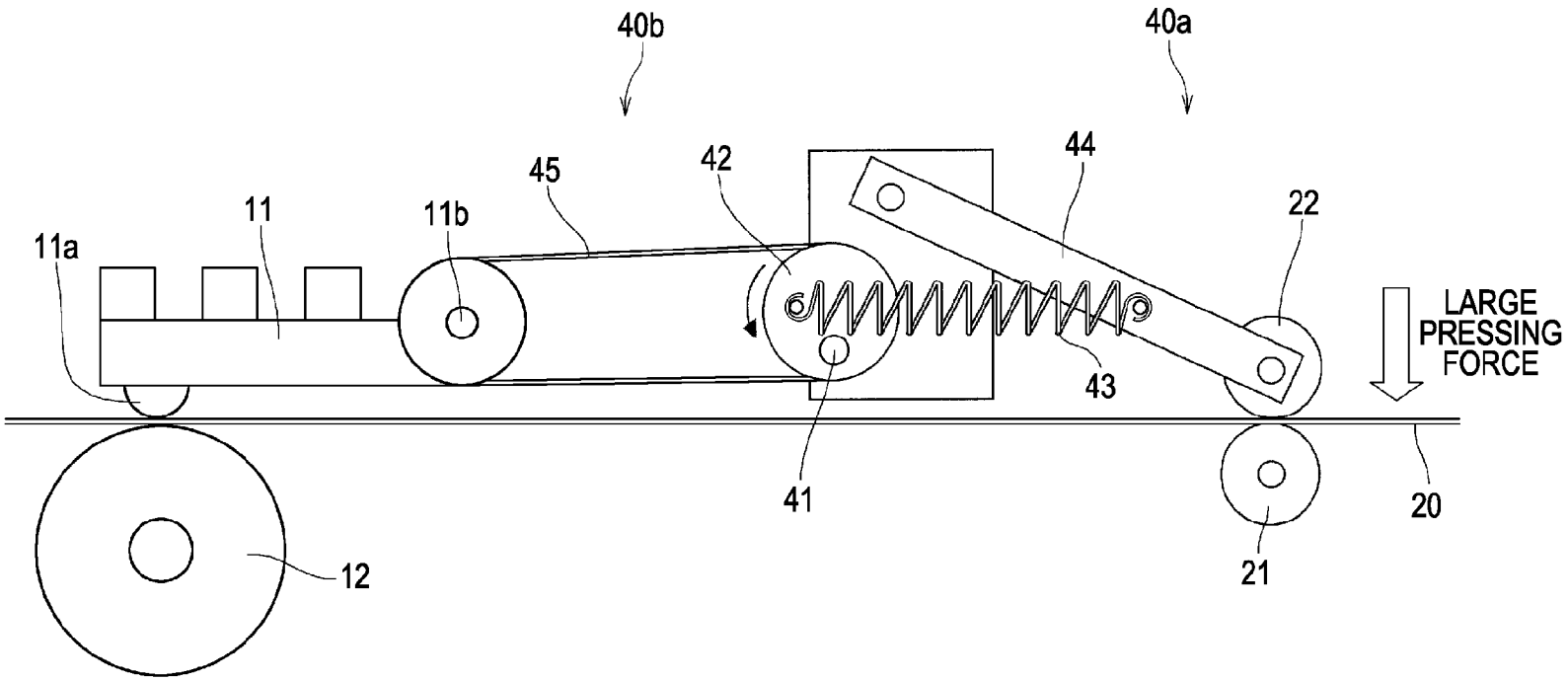
FIG. 11 is a front view of another exemplary pressing force application unit in a thermal printer serving as an image formation apparatus according to an embodiment of the present invention, showing a state in which a large pressing force is applied.

FIG. 11 is a front view of another exemplary pressing force application unit (a pressing device 40*a*) in a thermal printer 10 serving as an image formation apparatus according to an embodiment of the present invention, showing a state in which a large pressing force is applied.

Figure 12:
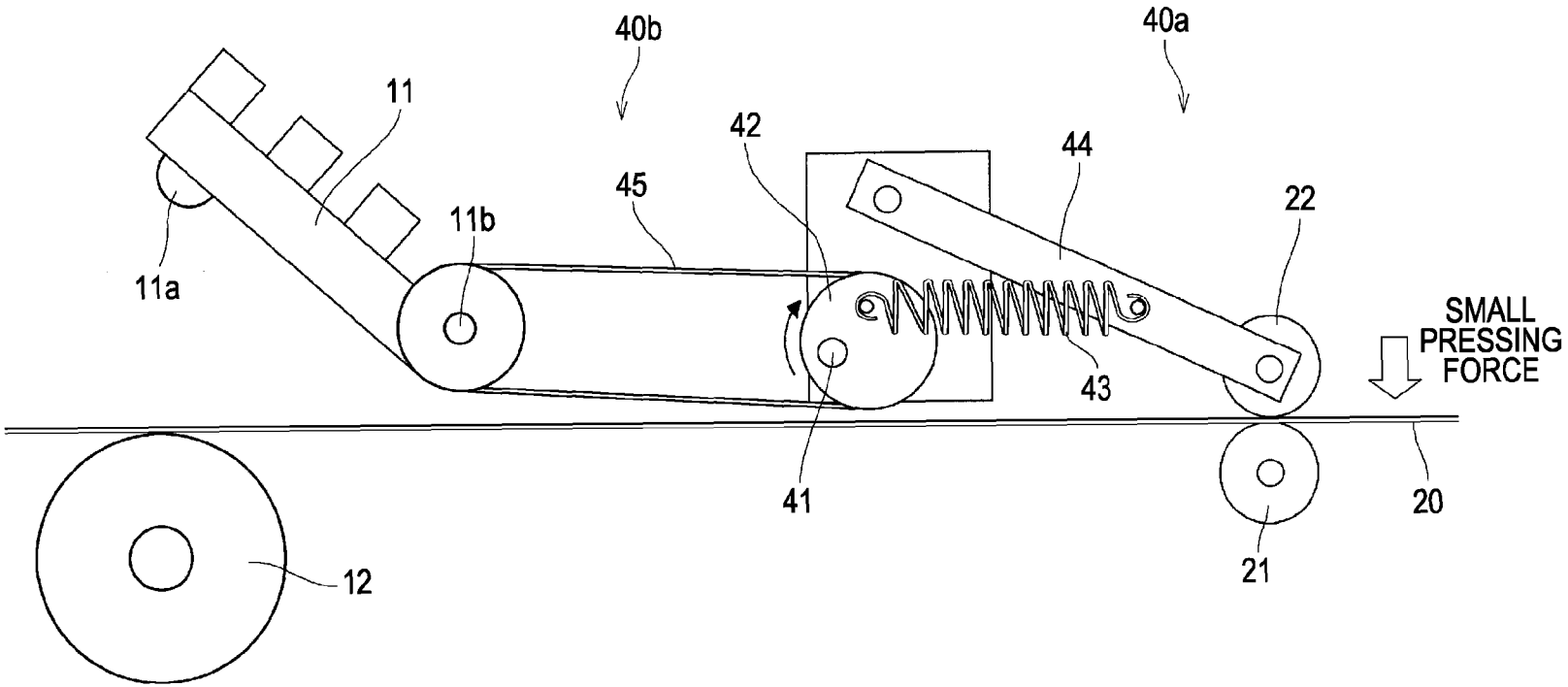
FIG. 12 is a front view of the other exemplary pressing force application unit in the thermal printer serving as the image formation apparatus according to the embodiment of the present invention, showing a state in which a small pressing force is applied.

Meanwhile, FIG. 12 is a front view of the other exemplary pressing force application unit (the pressing device 40*a*) in the thermal printer 10 serving as the image formation apparatus according to the embodiment of the present invention, showing a state in which a small pressing force is applied.

As shown in FIGS. 11 and 12, a pressing device 40*a* includes an eccentric cam 42 that rotates about a rotary shaft 41 displaced from the center of the eccentric cam 42, and a coil spring 43 that contracts by a variable amount in accordance with rotation of the eccentric cam 42. One end of the coil spring 43 is attached to an arm 44 that supports the pinch roller 22. An elastic belt 45 is wound around between the thermal head 11, which is rotatable about a center shaft 11*b*, and the eccentric cam 42. The eccentric cam 42 and the elastic belt 45 form a contact/separation device 40*b*.

When the rotary shaft 41 is rotated counterclockwise by rotating a motor (not shown), the eccentric cam 42 is rotated counterclockwise to expand the coil spring 43 and strongly pull the arm 44 as shown in FIG. 11. Therefore, the pressing force of the pinch roller 22 is increased. The counterclockwise rotation of the eccentric cam 42 also rotates the thermal head 11 counterclockwise about the center shaft 11*b* to bring the heat resistors 11*a* into pressure contact with the platen 12 via the printing paper 20. Thus, even if the thermal head 11 is descended to increase the transfer load of transferring the printing paper 20, sufficient transfer power is reliably produced by rotation of the capstan 21. This allows accurate transfer of the printing paper 20 to prevent color deviation.

Meanwhile, when the rotary shaft 41 is rotated clockwise by rotating the motor (not shown), the eccentric cam 42 is rotated clockwise to contract the coil spring 43 and weaken the force pulling the arm 44 as shown in FIG. 12. Therefore, the pressing force of the pinch roller 22 is reduced. The clockwise rotation of the eccentric cam 42 also rotates the thermal head 11 clockwise about the center shaft 11*b* to separate the heat resistors 11*a* from the platen 12. Thus, the load of transferring the printing paper 20 is low, and it is therefore possible to accurately transfer the printing paper 20 since the pressing force of the pinch roller 22 is small even if the transfer power of the capstan 21 is low. The small pressing force of the pinch roller 22 also makes it possible to further suppress capstan traces.

As described above, the pressing device 40*a* adjusts the pressing force of the pinch roller 22 in conjunction with the contact/separation device 40*b*. Therefore, the pressing force of the pinch roller 22 may be increased and reduced to adjust the transfer power of the capstan 21 in accordance with transfer power necessary to transfer the printing paper 20. This results in color printing with no color deviation and further suppressed capstan traces to improve the printing quality. The pressing device 40*a* and the contact/separation device 40*b* configured as described above are especially effective for printing paper 20 with a large printing area for which it is necessary to increase the power for transferring the printing paper 20 (which tends to leave remarkable capstan traces).

While embodiments of the present invention have been described above, the present invention is not limited thereto, and may be modified variously as described below, for example.

(1) While the printing paper 20 (a paper medium) is used as the recording medium in the embodiments, the present invention is not limited thereto, and the recording medium may be a plastic medium. A different type of platen may be used rather than the platen 12 in a roller shape used in the embodiments.

(2) In the embodiments, the fixation springs 23 and the adjustment springs 24 and the coil spring 43 connected to the pinch roller 22 are used as the pressing force application unit configured to exert a pressing force to press the capstan 21 and the pinch roller 22 against each other via the printing paper 20.

However, an elastic member other than a spring may be used as the pressing force application unit. The pressing force may be exerted on the capstan 21 rather than on the pinch roller 22.

(3) In the embodiment, the eccentric cam 42 and the elastic belt 45 are used as the contact/separation unit configured to contact/separate the thermal head 11 and the platen 12 with/from each other via the printing paper 20. The thermal head 11 is rotated about the center shaft 11*b* to contact and separate from the platen 12.

However, the contact/separation unit may be configured to ascend and descend the entire thermal head 11 rather than rotating the thermal head 11. Rather than moving the thermal head 11, the platen 12 may be moved to contact and separate from the thermal head 11.

The present application contains subject matter related to that disclosed in Japanese Priority Patent Application JP 2009-096660 filed in the Japan Patent Office on Apr. 13, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image formation apparatus comprising:

a thermal head on which a plurality of heat elements are arranged to form an image on a recording medium;

a platen provided opposite the thermal head to pass the recording medium between the platen and the thermal head;

a contact/separation unit configured to contact/separate the thermal head and the platen with/from each other via the recording medium;

a capstan that transfers the recording medium;

a pinch roller provided opposite the capstan to pass the recording medium between the pinch roller and the capstan; and a pressing force application unit configured to exert a pressing force to press the capstan and the pinch roller against each other via the recording medium, wherein, the capstan includes a plurality of projections on a pressing surface of the capstan that presses the recording medium, a height of each of the projections from the pressing surface is defined as H, and the height H is in a range of $20\ \mu m < H \leqq 40\ \mu m$, the pressing force application unit includes a pair of fixation springs and a pair of adjustment springs provided at both ends of the pinch roller to urge the pinch roller toward the capstan, one fixation spring and one adjustment spring being respectively provided at each end of the pinch roller, and each of the adjustment springs is coupled to the thermal head so as to produce a smaller spring force when the contact/separation unit establishes no contact between the thermal head and the platen than the spring force produced when the contact/separation unit establishes the contact between the thermal head and the platen.

2. The image formation apparatus according to claim 1, wherein the capstan includes two rows of projections at both ends of the pressing surface of the capstan that presses the recording medium, each row of projections including multiple projections.

3. The image formation apparatus according to claim 1, wherein each of the projections is formed in such a shape that power for transferring the recording medium in an image formation direction is higher than power for transferring the recording medium in the opposite direction.

4. The image formation apparatus according to claim 1, wherein each of the projections has a trapezoidal cross section, a length of an upper base of the trapezoid is defined as L, and the length L is in a range of $0\ \mu m < H \leqq 50\ \mu m$.

5. The image formation apparatus according to claim 1, wherein each of the fixation springs is configured to exert a constant spring force on the pinch roller.

6. The image formation apparatus according to claim 5, wherein the image formation apparatus further includes a housing, and each of the fixation springs is coupled to the housing.

7. The image formation apparatus according to claim 1, wherein a pressing force exerted by the pressing force application unit when no contact between the thermal head and the platen is established is smaller than a pressing force exerted by the pressing force application unit when the contact between the thermal head and the platen is established.

8. The image formation apparatus according to claim 1, wherein the adjustment springs are pulled in accordance with a descent of the thermal head so as to increase the pressing force.

9. The image formation apparatus according to claim 1, wherein the adjustment springs are contracted in accordance with an ascent of the thermal head so as to reduce the pressing force.

* * * * *